United States Patent [19]

Pirtle et al.

[11] Patent Number: 4,585,390

[45] Date of Patent: Apr. 29, 1986

[54] VANE RETAINING MEANS

[75] Inventors: George M. Pirtle, Loveland; Ronald C. Acres, Hamilton, both of Ohio

[73] Assignee: General Electric Company, Cincinnati, Ohio

[21] Appl. No.: 616,625

[22] Filed: Jun. 4, 1984

[51] Int. Cl.[4] ..... F04D 29/56; F04D 29/64

[52] U.S. Cl. ..... 415/160; 415/189; 415/217

[58] Field of Search ..... 415/9, 149 R, 159, 160, 415/161, 162, 163, 164, 189, 190, 216–218

[56] References Cited

U.S. PATENT DOCUMENTS

| | | | |
|---|---|---|---|
| 2,388,208 | 10/1945 | Foss | 415/160 |
| 2,622,790 | 12/1952 | McLeod | 415/218 |
| 2,625,367 | 1/1953 | Rainbow et al. | 415/217 UX |
| 2,671,634 | 3/1954 | Morley | 415/160 |
| 2,894,318 | 7/1959 | Bloomberg | 415/216 X |

FOREIGN PATENT DOCUMENTS

| | | | |
|---|---|---|---|
| 624777 | 6/1949 | United Kingdom | 415/217 |
| 496377 | 3/1976 | U.S.S.R. | 415/189 |

*Primary Examiner*—Robert E. Garrett

*Assistant Examiner*—Joseph M. Pitko

*Attorney, Agent, or Firm*—Douglas S. Foote; Derek P. Lawrence

[57] ABSTRACT

Stator vane retaining means such as may be used in a compressor of a gas turbine engine is disclosed. The compressor is the type including a casing with first and second annular members and a plurality of vanes, each vane having a vane axis and a root end for mounting to the casing. The stator vane retaining means comprise a first flange extending radially outwardly from the first member and a second flange extending radially outwardly from the second member. The second flange includes a plurality of radially extending recesses. The flanges are adapted to mate so that the first flange encloses the recesses thereby forming a plurality of radially extending holes. Each of the holes is adapted to receive one of the root ends. The stator vane retaining means may also include a plurality of bolts extending through the flanges and intersecting a cut-out portion of each of the root ends of the vanes. In this manner, radial retention of each of the vanes is provided. In a further form of the present invention, the cut-out portion may be contoured and cooperate with the bolt so as to allow limited rotational motion about the vane axis.

2 Claims, 4 Drawing Figures

VANE RETAINING MEANS

This invention relates generally to a gas turbine engine and, more particularly, to vane retaining means in a compressor of such a gas turbine engine.

BACKGROUND OF THE INVENTION

Gas turbine engines generally comprise a compressor for compressing air flowing through the engine, a combustor in which fuel is mixed with the compressed air and ignited to form a high-energy gas stream, and a turbine which includes a first rotor for driving the compressor. In addition, many gas turbine engines are of the turbofan type in which a fan located forward of the compressor is driven by a second turbine rotor. The fan produces a flow stream which bypasses the compressor, combustor, and turbine to provide propulsion.

In assembling such gas turbine engines, the compressor with its many rotating blades and stationary vanes typically is assembled separately from the fan section. The rotating blades extend radially outwardly from disks which are attached to the first compressor rotor. The non-rotating vanes are interposed between successive blade stages and extend radially inwardly from a compressor casing.

The fan section includes a frame member to which the compressor casing may be fastened during assembly. In order to join the compressor and fan section together, it is known to include a radially directed flange on the forward end of the compressor casing in order to provide a surface for fastening to the fan frame. For example, axially directed bolts may extend through the frame and this flange to provide such fastening. Such flanges are effective for the purpose described, but add weight to the engine.

Non-rotating compressor stator vanes are attached at a root end of a vane to the compressor casing. At the point where each root attaches to the compressor casing, the root typically penetrates the casing and is retained by a boss formed on the outer side of the casing. Each vane requires a boss for its retention. In high solidity vane rows, i.e. vane rows with a relatively large number of vanes, the number of local bosses becomes so great that use of a continuous flange or ring with individual holes for each vane root becomes economical.

In order to improve engine efficiency at all operating conditions, it is known to supply actuating means for compressor stator vanes. Such actuating means typically attach to a root end of the vane and are effective for changing the vane pitch by rotating the vane about a vane axis. The actuation means is also responsible for limiting the amount of pitch variation as well as providing radial retention of each vane. In the event of a failure of the actuation means, a vane might spin on its axis creating vibration and other problems.

OBJECTS OF THE INVENTION

It is an object of the present invention to provide new and improved stator vane retaining means.

It is another object of the present invention to provide a lightweight compressor casing.

It is a further object of the present invention to provide failsafe stator vane retaining means which provide both radial retention and limit the range of motion about the vane axis.

SUMMARY OF THE INVENTION

One form of the present invention comprises stator vane retaining means for use in a compressor of a gas turbine engine. The compressor includes a casing with first and second annular members, and a plurality of vanes, each vane having an axis and a root end for mounting to the casing. The vane retaining means comprise a first flange extending radially outwardly from the first member, and a second flange extending radially outwardly from the second member. The second flange includes a plurality of radially extending recesses. The flanges are adapted to mate so that the first flange encloses the recesses on the second flange, thereby forming a plurality of radially extending holes. Each hole is adapted to receive one of the root ends.

According to another form of the present invention, the vane retaining means further comprise a plurality of bolts extending axially through the flanges and intersecting with a cut-out portion of each of the root ends thereby providing radial retention of each of the vanes.

DETAILED DESCRIPTION OF THE INVENTION

Figure 1:
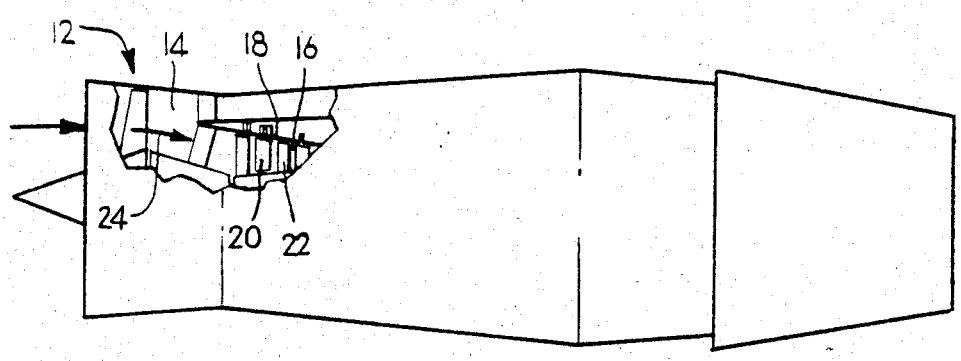
FIG. 1 is a schematic of a gas turbine engine with compressor stator vane retaining means according to one form of the present invention.

FIG. 1 shows a gas turbine engine 12 with fan section 14 and compressor 16 shown in a cut-away view. Compressor 16 includes an annular casing 18 which supports a plurality of vanes 20. Casing 18 also circumferentially surrounds rotor blades 22 and forms the outer boundary of air flowpath 24 through compressor 16. In assembling engine 12, compressor 16 with its various vanes 20 and blades 22 is typically formed separately from fan section 14. The forward end of compressor 16 is joined to fan section 14 as shown in more detail in FIG. 2.

Figure 2:
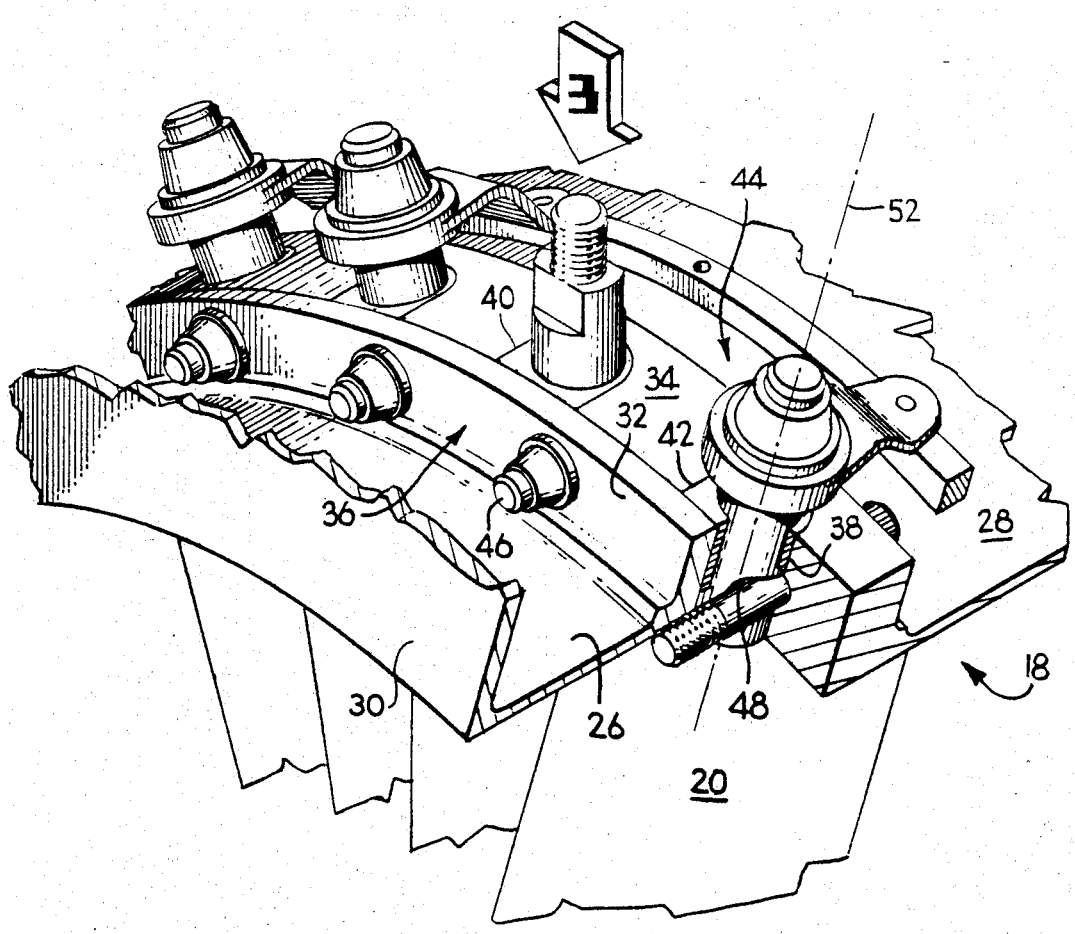
FIG. 2 is a perspective view of stator vane retaining means according to one form of the present invention.

FIG. 2 shows casing 18 circumferentially split into first annular member 26 and second annular member 28. Although first annular member 26 forms part of casing 18, it is integrally attached to fan frame 30 or otherwise brazed or welded thereto. First annular member 26 includes a first flange 32 which extends radially outwardly from first member 26. Second annular member 28 includes a second flange 34 which extends radially outwardly from second annular member 28. Together, first and second flanges 32 and 34 comprise stator vane retaining means 36.

In the embodiment shown, second flange 34 includes a plurality of radially extending recesses 38. Flanges 32 and 34 are adapted to mate in the manner shown so that first flange 32 covers and encloses each recess 38 on second flange 34. Thus, a plurality of radially extending holes 40 are formed. Each hole 40 is sized so as to receive a root end 42 of stator vane 20. Each root end 42 extends through a hole 40 and is attached at its radially outer end to vane actuation means 44.

Figure 3:
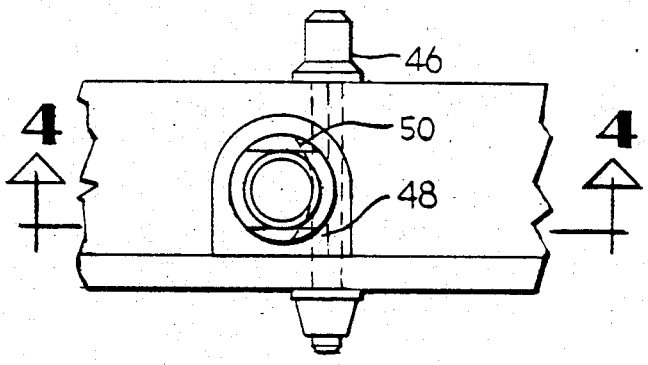
FIG. 3 is a view taken along arrow 3 in FIG. 2.
Figure 4:
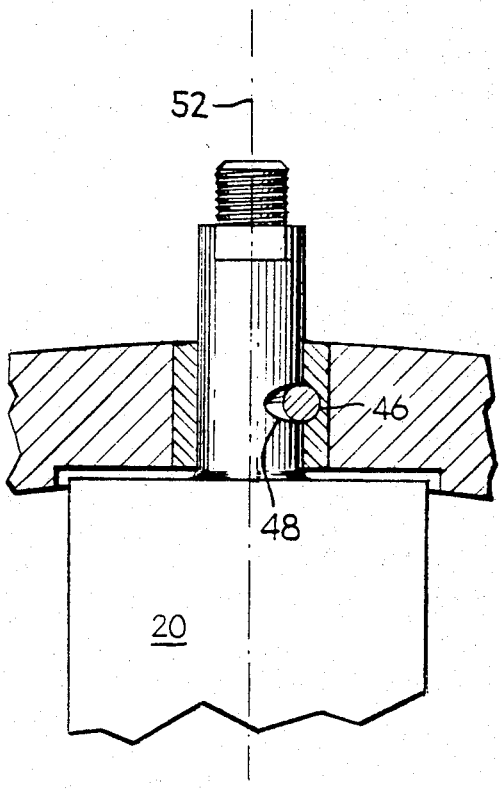
FIG. 4 is a view taken along the line 4—4 in FIG. 3.

Another feature of the present invention, which is part of stator vane retaining means 36, is fastening means, shown in FIG. 2 as bolts 46. Each bolt 46 extends axially through first and second flanges 32 and 34 to fasten these flanges together. As shown in FIG. 2 and in more detail in FIGS. 3 and 4, as each bolt 46 passes through flanges 32 and 34, it intersects a cut-out portion 48 on root end 42. Bolt 46 and cut-out portion 48 thereby cooperate to provide radial retention of blade 20. Cut-out portion 48 does not extend fully around root end 42. Rather, it extends only partially around root end 42 and is contoured to a crescent shape 50, shown in FIG. 3.

In operation, vane actuation means 44 provide rotational motion about vane axis 52. Vane actuation means 44 may also provide radial retention of vane 20 as well as control the degree of rotation of vane 20. However, bolts 46 cooperate with cut-out portion 48 to provide redundancy in the form of radial vane retention as well as limiting the degree of rotational motion about vane axis 52.

It will be clear to those skilled in the art that the present invention is not limited to the specific embodiments described and illustrated herein. Nor is the invention limited to stator vane retaining means wherein only one flange has radially extending recesses. Rather, the invention applies equally to vane retaining means wherein both flanges have radially extending recesses and are adapted to mate so that the corresponding recesses form a hole to receive a stator vane root end.

It will be understood that the dimensions and proportional and structural relationships shown in these drawings are illustrated by way of example only, and those illustrations are not to be taken as the actual dimensions or proportional structural relationships used in the stator vane retaining means in the present invention.

Numerous modifications, variations, and full and partial equivalents can now be undertaken without departing from the invention as limited only by the spirit and scope of the appended claims.

What is desired to be secured by Letters Patent of the United States is the following.

What is claimed is:

1. In a compressor including a casing with first and second annular members, and a plurality of vanes, each vane having a vane axis and a root end for mounting to said casing, a stator vane retaining means comprising:

a first flange extending radially outwardly from said first member;

a second flange extending radially outwardly from said second member, said second flange including a plurality of radially extending recesses;

wherein said flanges are adapted to mate so that said first flange encloses said recesses thereby forming a plurality of radially extending holes, each of said holes being adapted to receive one of said root ends; and a fastening means for joining said flanges, comprising a plurality of bolts extending axially through said flanges and intersecting with a cut-out portion of each of said root ends, thereby providing radial retention of each of said vanes.

2. Stator vane retaining means, as recited in claim 1, wherein said cut-out portion is contoured so as to allow limited rotational motion of said vane about said vane axis.

* * * * *